US005390623A

United States Patent [19]

Mackaness

[11] Patent Number: 5,390,623

[45] Date of Patent: Feb. 21, 1995

[54] BOAT HULL

[76] Inventor: Miles P. Mackaness, 5580 Chisolm Rd., Johns Island, S.C. 29455

[21] Appl. No.: 133,467

[22] Filed: Oct. 8, 1993

Related U.S. Application Data

[63] Continuation-in-part of Ser. No. 847,932, Mar. 6, 1992, abandoned.

[51] Int. Cl.[6] ..... B63B 1/30

[52] U.S. Cl. ..... 114/282; 114/283; 114/284

[58] Field of Search ..... 114/271, 274, 280, 282, 114/284, 286, 135-137, 140, 152, 126, 142, 143, 283, 288

[56] References Cited

U.S. PATENT DOCUMENTS 3,051,115 8/1962 Canazzi ..... 114/288 X
3,998,176 12/1976 Stout et al. ..... 114/283
4,058,077 11/1977 Johansson ..... 114/283
4,378,748 4/1983 Kurtz ..... 114/141
4,669,408 6/1987 Schad ..... 114/283 X

FOREIGN PATENT DOCUMENTS 0806750 12/1936 France ..... 12/193.6

*Primary Examiner*—Sherman Basinger
*Attorney, Agent, or Firm*—Dority & Manning

[57] ABSTRACT

Boat hull or attachment with a plurality of longitudinally movable elements. Presently preferred embodiments utilize wings or ski members which are movable and maintainable between multiple positions to adjust the operational characteristics of the boat. The wings extend from the transom longitudinally along the aft half of the boat and include upwardly curved foil shaped front edges to provide lift. The ski members will generally extend along a substantial extent of the length of the boat. Bottom running surfaces of the respective ski members may be varied in angular disposition to operatively simulate a plurality of hull configurations.

40 Claims, 10 Drawing Sheets

BOAT HULL

This is a continuation-in-part of application Ser. No. 07/847,932, filed Mar. 6, 1992, now abandoned.

BACKGROUND OF THE INVENTION

The present invention relates generally to boat hulls and attachments, and more particularly to an improved boat hull or attachment that is adjustable for various operating conditions. Two basic hull configurations for powered boats are the V-hull design and the flat bottom design. Both designs are ideal for certain operating conditions and have substantial drawbacks in other operating conditions. For example, a V-hull boat is fast and an excellent design in light choppy seas offshore, where its strakes and deep entry allow excellent stability at speed offshore. However, in calmer areas such as an estuary or river (or calm offshore seas), the V-shape design produces excessive wake and requires more power to operate than other designs under similar conditions. In addition, the V-hull design is less efficient to operate because of the surface area of hull that is in contact with water, and the resulting friction and drag caused by contact between the hull and the water.

On the other hand, a flat bottom design hull is excellent at sea when the waters are calm and the boat's speed is relatively slow. However, when seas become rough and a relatively fast speed is desired, the flat bottom boat is unstable and rocks in a dangerous and uncomfortable manner, making it impractical to maintain a planing speed.

SUMMARY OF THE INVENTION

The present invention recognizes and addresses the foregoing disadvantages, and others of prior art constructions and methods.

Accordingly, it is an object of the present invention to provide an improved boat hull that enhances the performance of a vessel.

It is another object of the present invention to provide an attachment that can be secured to a conventional boat hull to enhance the performance of the vessel.

It is a further object of the present invention to provide a boat hull or attachment that is adaptable to various operating conditions such as rough or calm seas, at high or low speeds.

It is another object of the present invention to provide a boat hull or attachment that can be configured to operationally simulate various hull configurations on a vessel.

These and other objects are accomplished by providing an improved boat hull comprising a primary hull section extending in a longitudinal direction and defining a bottom of a boat, the primary hull section including a fore and aft portion. Additionally, the teachings of the invention may be embodied in apparatus adapted for attachment to an existing boat hull in a retrofit manner to accomplish objectives of the invention.

In some presently preferred embodiments, the improved boat hull also includes first and second longitudinally extending wings, each pivotally attached to the primary hull section along an axis extending in the longitudinal direction of the primary hull section, with the wings extending from the aft portion of the primary hull section along the length of the primary hull section to a point past the center of gravity of the boat. The improved boat hull also including means for pivoting the longitudinally extending wings between at least a first position and a second position and maintaining the wings in such positions to enhance the performance of the boat in a variety of water conditions and boat speeds.

Such wings may be infinitely pivotal between the first and second positions, and capable of being maintained in at least the following general positions depending upon the particular configuration of the boat hull: (1) flush with the hull of the boat; (2) in a plane substantially parallel to the surface of the water; (3) past the horizontal plane that is parallel to the water surface, with the wings forming an inverted V configuration; and (4) substantially perpendicular to the water surface. The wings each include an inside edge portion and an outside edge portion and front and back edge portions, and the wings are attached to the primary hull section at their inside edge portions. The outside front edge portions of the wings may be curved upwardly and foil shaped to provide lift and are not directly attached to the hull.

Other embodiments of the present invention utilize first and second elongated ski members generally extending in spaced apart relationship from the fore portion to the aft portion of the primary hull section. The ski members are adapted to be selectively moved by appropriate actuator means between a retracted first position generally adjacent the primary hull section and an extended second position in which separable portions thereof are displaced from the primary hull section. As a result, the ski members may be extended into the second position during operation of the boat to permit the boat hull to traverse a body of water substantially thereon.

In presently preferred embodiments, the ski members are connected to a forward keel area of the primary hull section. Such attachment may be facilitated by glues or other polymeric bonding agents of sufficient strength. Also, a hinge or a coupling joint may be utilized for this purpose. From such point of attachment, the ski members preferably extend substantially in parallel back to respective opposite bottom corners of the hull transom.

The ski members may be embodied as a generally thin ski member having an inner surface complementary to a corresponding portion of an outer surface of the primary hull section. Such ski members, some embodiments of which are particularly amenable to retrofit applications, may be configured having a generally flat first portion integrally extending in a longitudinal direction into an angled second portion. The flat first portion facilitates attachment of the respective ski member to the forward keel area, while the angled second portion permits the ski member to "wrap around" an outer chine of the primary hull section when retracted in the first position.

Each of the ski members may also be adapted for receipt into a respective longitudinal recess defined in the primary hull section. Due to the recess, an outer surface of a retracted ski member may appear flush with the primary hull section. In some such embodiments, the ski member may be configured having a generally flat first portion integrally extending into a generally quadrilateral second portion. The quadrilateral second portion provides a box-like configuration of significant stability and strength.

Preferably, the actuator means are further operative to selectively vary the angular disposition of the ski members. Such variation permits the ski members to cooperatively simulate a number of different hull configurations which may be desirable under particular prevailing conditions. Additionally, the actuator means may further include support means positioned at an intermediate location between the fore portion and the aft portion of the primary hull section. Such support means provide additional support to the ski members while extended into the second position. The support means may also be adapted to operatively flex the respective ski members into selected inward and outward arcuate contours which may be used to alter the attitude of the primary hull section during operation.

To move the ski members, the actuator means may utilize fluid actuated cylinders located at the aft portion of the primary hull section, such as at the transom. Angular variation of the respective ski members may be accomplished by additional cylinders or appropriate telescoping members. Alternatively, rack assemblies may be utilized in which an arcuate rack, driven by an appropriate gear element or other drive means, is fixedly connected to a respective ski member. Other objects, features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying figures, in which.

Figure 1:
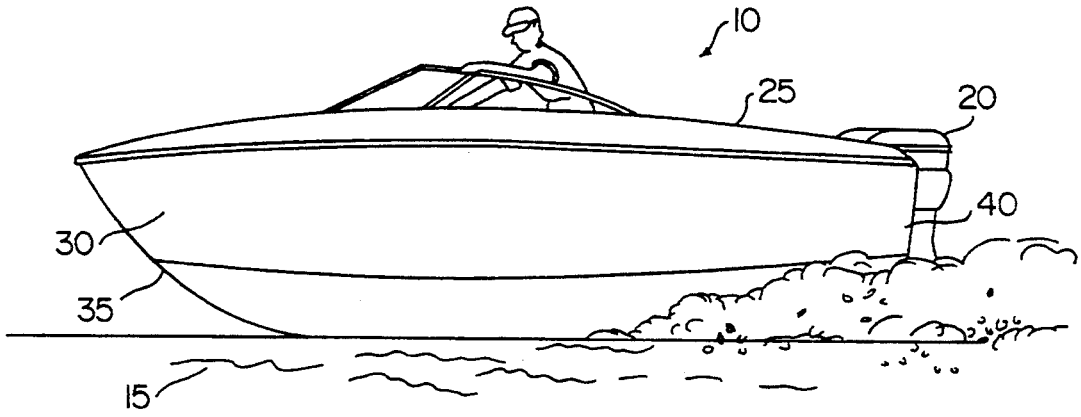
FIG. 1 is a perspective view of a powerboat in the water utilizing an embodiment of the present invention.

Repeat use of reference characters in the present specification and drawings is intended to represent same or analogous features or elements of the invention.

DETAILED DESCRIPTION OF PREFERRED EMBODIMENTS

It is to be understood by one of ordinary skill in the art that the present discussion is a description of exemplary embodiments only, and is not intended as limiting the broader aspects of the present invention, which broader aspects are embodied in the exemplary construction.

Referring to FIG. 1, a power boat, generally illustrated at 10, is shown moving through water 15 propelled by outboard engines or motors 20. The boat includes a hull 25 that defines a primary hull section 30. Primary hull section 30 includes a fore portion 35 and an aft portion 40. The boat hull 25 illustrated in FIG. 1 is generally known as a V-hull design. While a relatively small recreational vessel 10 is illustrated in FIG. 1, it should be understood by one of ordinary skill in the art that the present invention has applicability to a wide range of vessels, extending from small recreational vessels to large commercial or military vessels such as navy destroyers. It should be appreciated by one of ordinary skill in the art that the principles set forth in the present disclosure are equally applicable to a variety of types of vessels as set forth above.

Figure 2:
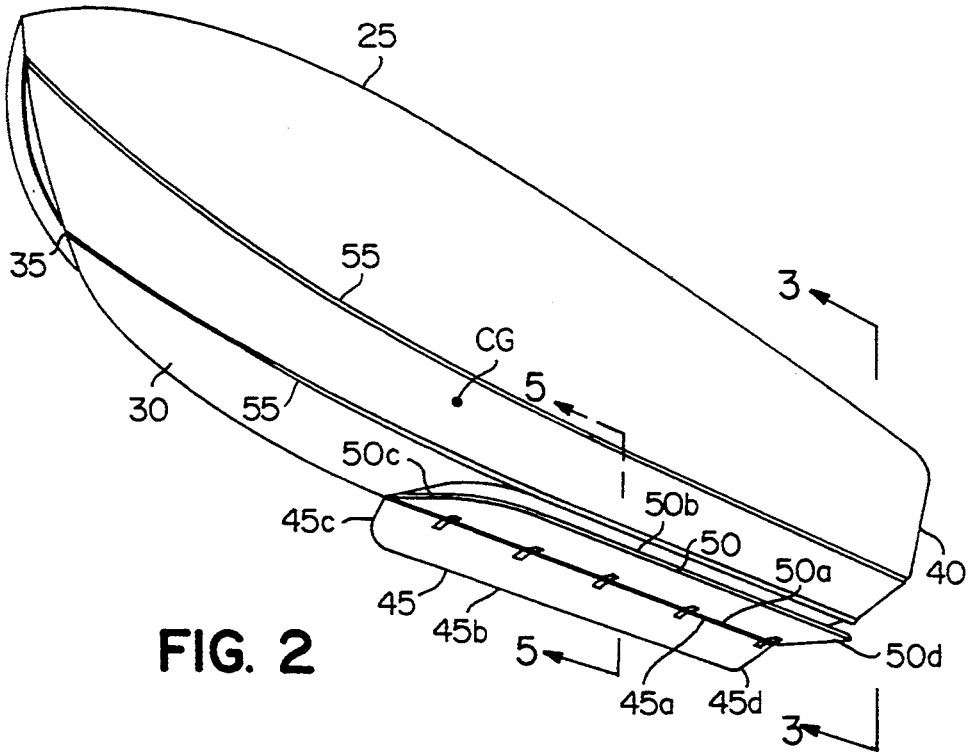
FIG. 2 is a perspective view of a vessel out of the water illustrating an embodiment of the present invention.

FIG. 2 illustrates a V-shaped boat hull 25 in accordance with the present invention with fore portion 35 and aft portion 40 illustrated. As shown in FIG. 2, the present invention includes a first longitudinally extending wing 45 and a second longitudinally extending wing 50. Each wing includes an inside edge portion 45*a*, 50*a*, respectively, outside edge portions 45*b*, 50*b*, respectively, front edge portions 45*c*, 50*c*, and back edge portions 45*d*, and 50*d*, respectively.

Wings 45, 50 are pivotally attached along their inside edges to primary hull section 30 along an axis extending in the longitudinal direction of boat hull 25. In a preferred embodiment, wings 45, 50 may extend from slightly behind the transom of the boat along the aft half of the primary hull section. Wings 45, 50 extend to a position adjacent a longitudinally middle portion of the hull and preferably past the center of gravity (CG in FIG. 2) of the boat. The various particular attachment mechanisms will be described hereinafter. Also illustrated in FIG. 2 are strakes 55 integral with the V-shape hull to provide lateral stability to the boat.

Figure 3:
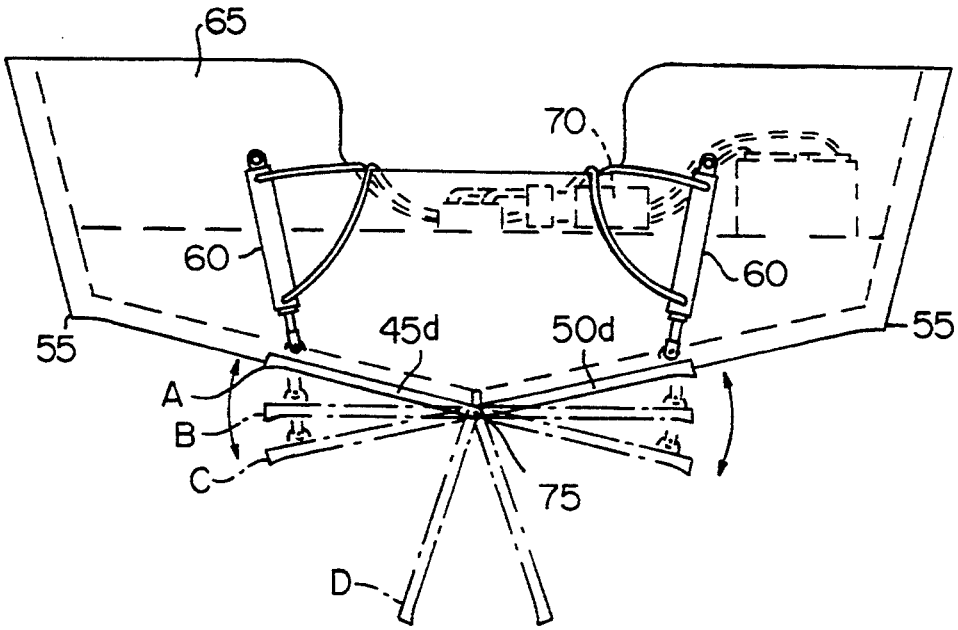
FIG. 3 is an end view of the vessel of FIG. 2 along lines 3—3.

The present invention also includes power operated means for pivoting the longitudinally extending wings between multiple positions. As embodied herein and illustrated most particularly in FIGS. 3 and 4, the means for pivoting includes at least one, and preferably a plurality, of fluid actuated cylinders 60 that are connected between the transom 65 of the boat and the back portions 45*d*, 50*d* of the longitudinally extending wings 45, 50. The fluid actuated cylinders 60 are pivotally attached at both ends so that when actuated by a fluid pump 70, fluid actuated cylinder 60 will cause the first and second longitudinally extending wings 45, 50 to move between their respective positions. These respective positions are best illustrated in FIG. 3 at A, B, C and D. In addition, the means for pivoting could include any mechanical pivoting mechanism that would accomplish the same purpose.

Position A illustrates longitudinally extending wings 45, 50 flush with primary hull section 30 so that said boat hull operates in a substantially conventional manner. As noted in FIG. 3, when the longitudinally extending wings 45, 50 are in position A, they function merely as additional strakes 55 on the primary hull section for providing lateral stability to the boat as it moves through the water. This position is best adapted for use at high speed and rough water in the same manner that the conventional V-hull boat is optimal.

Position B illustrates longitudinally extending wings 45, 50 extending in a plane substantially horizontal and parallel to the surface of the water. Such a position provides the hull of the present invention with operating characteristics similar to a flat bottom skiff and is particularly desirable offshore in calm seas or in estuaries or rivers at high speeds where the water is calm.

Position C illustrates the longitudinally extending wings 45, 50 extending past the horizontal plane to a position forming an inverted V. This position provides the advantages of Position B described above, but with enhanced speed. In Position C, when the boat reaches planing speed, the boat rides on longitudinally extending wings 45, 50 and these wings provide a lifting force to lift the hull out of the water providing reduced friction between the hull and water and enhanced operational characteristics. In these positions at planing speed, the boat is skimming across the surface of the water on the wings 45, 50. In addition, in Position C, the slightly inverted V shape of the longitudinally extending wings will serve to funnel an increased amount of water to the engine propeller therefor additionally enhancing the speed of the boat.

Position D illustrates what may be referred to as a keel position in which the longitudinally extending wings are extended well past the horizontal plane to a position substantially perpendicular to the water line. This position acts as a keel for the boat thereby minimizing the amount of roll and yaw of the boat proportionate to the speed at which it is moving.

It should be understood by one of ordinary skill in the art that the longitudinally extending wings are infinitely adjustable between Position A and Position D so that the exact location of these positions may vary with the particular operating characteristics of the hull to which the wings are attached. This infinite adjustment is provided by the fluid actuated cylinder 60. For example, Position C could be most efficient for a particular hull when located substantially more past the horizontal than illustrated in FIG. 3.

Figure 4:
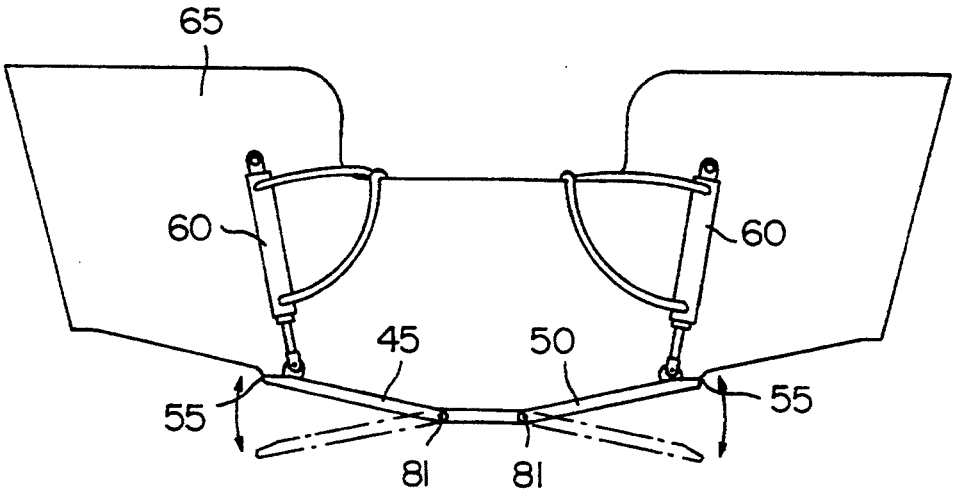
FIG. 4 is another end view of a vessel as in FIG. 2 illustrating another embodiment of the attachment mechanism for the wings.

The embodiment of FIG. 3 illustrates the longitudinally extending wings 45, 50 being pivotally attached to the hull along a single longitudinal axis 75. FIG. 4 illustrates wings 45, 50 being attached about separate but parallel longitudinal axes 80, 81 in a slightly different hull configuration.

Figure 5:
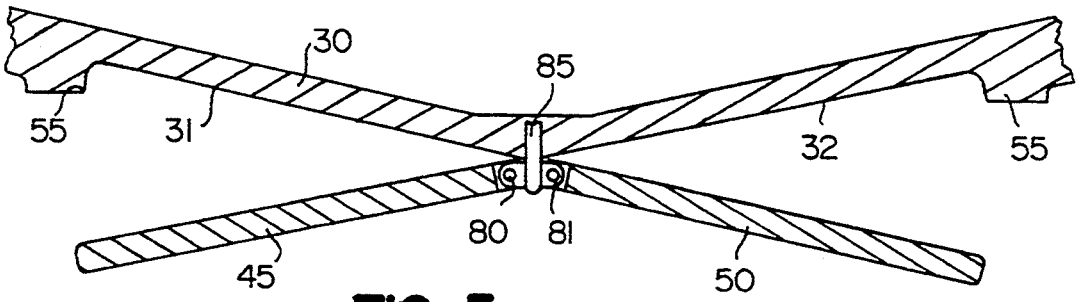
FIG. 5 is a cross section taken along lines 5—5 of FIG. 2.

Referring to FIG. 5, one means of mounting longitudinally extending wings 45, 50 to the primary hull section 30 is illustrated. As discussed above, primary hull section 30 includes strakes 55. In the embodiment illustrated in FIG. 5, primary hull section 30 includes recessed portions 31, 32 into which longitudinally extending wings 45, 50 fit allowing longitudinally extending wings 45, 50 to be substantially flush with the bottom of the primary hull section when in Position A as set forth in FIG. 3. Also illustrated in FIG. 5 is one means of mounting the longitudinally extending wings to the primary hull section including a mounting plate 85 embedded or otherwise attached to the primary hull section, with the longitudinally extending wings 45, 50 being attached to parallel longitudinal axes illustrated again as 80, 81.

Figure 5A:
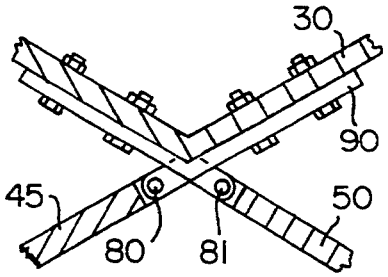
FIG. 5*a* is a cross section of another embodiment of an attachment mechanism as set forth in FIG. 5.

FIG. 5*a* discloses another means of mounting longitudinally extending wings 45, 50 to primary hull section 30, by use of a mounting plate 90 that is substantially X-shaped and bolted or otherwise attached to primary hull section 30, so that longitudinally extending wings 45, 50 will pivot about parallel longitudinally extending axes 80, 81. It is also well within the scope of the present invention for mounting means to consist of hinges molded into the primary hull section during the fabrication of such section with said longitudinally extending wings being attached thereto by one or more pivot rods or the like (not illustrated).

Figure 6:
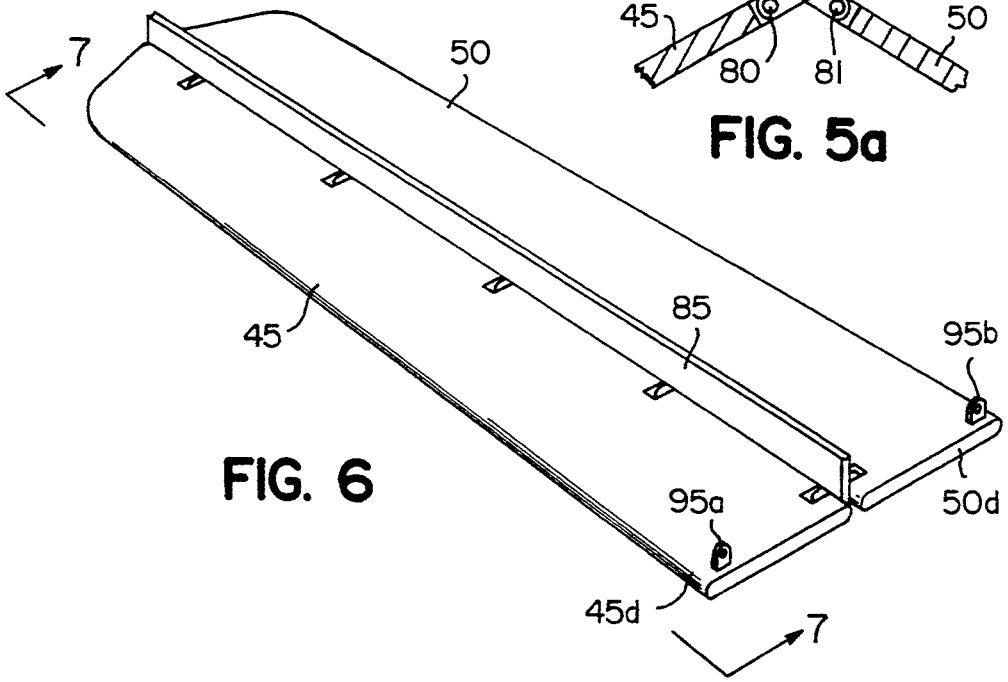
FIG. 6 is a perspective view of an embodiment of the wings shown without the vessel.

FIG. 6 illustrates the longitudinally extending wings 45, 50 detached from a boat hull. FIG. 6 illustrates a mounting plate 85 which is adapted to be connected to the boat hull and to which the longitudinally extending wings are pivotally attached. Elements 95*a* and 95*b* illustrate connectors adapted to be pivotally attached to fluid actuated cylinders 60, said connectors being located preferably on the back outer edge portions 45*d*, 50*d* of the longitudinally extending wings.

Figure 7:
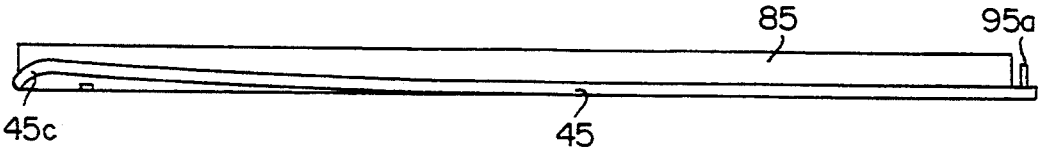
FIG. 7 is a side view of FIG. 6 taken along lines 7—7.

FIG. 7 illustrates a preferred configuration of the longitudinally extending wings 45, 50, particularly illustrating wing 45. As illustrated in FIG. 7, the outside front edge portion 45*c* (and also 50*c* of wing 50) curve upwardly so as to provide lift to the boat hull when in their lowered positions, such as at Position B and Position C. These curved portions, or upturned foils, also serve to maintain longitudinally extending wings 45, 50 flush with the primary hull section when said wings are in Position A.

As illustrated in FIGS. 2 and 7, the front outside edges of the wings are unsupported which allows a degree of flex in the wings during operation. In a preferred embodiment, wings 45, 50 are constructed of graphite and unidirectional fiberglass or Kevlar in a similar manner that water skis are constructed. Of course, it is within the scope of this invention to construct wings 45, 50 from any suitable material such as, for example, steel. A material such as discussed above, operating in conjunction with the unsupported nature of the front outside edge portions, enables the boat of the present invention to make sharp turns and provides a shock absorbing and safety function upon impact with any unexpected objects such as, for example, debris in the water.

Figure 8:
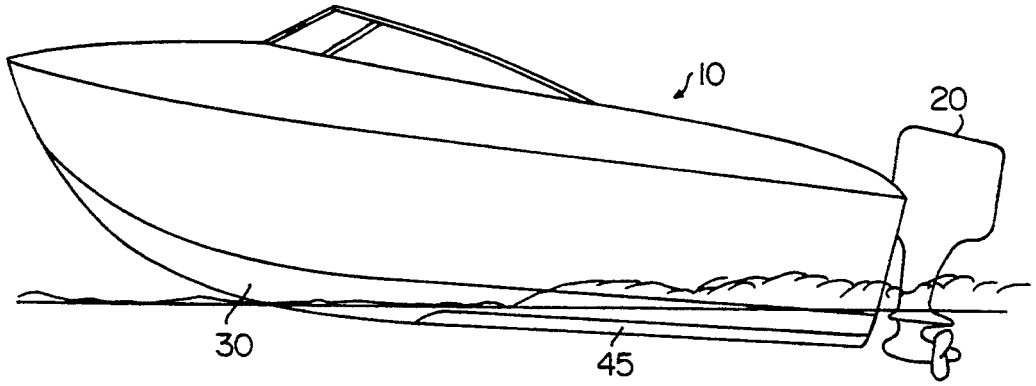
FIG. 8 is a side perspective view of a vessel incorporating one embodiment of the present invention with the wings in a position flush with the hull of the vessel.
Figure 9:
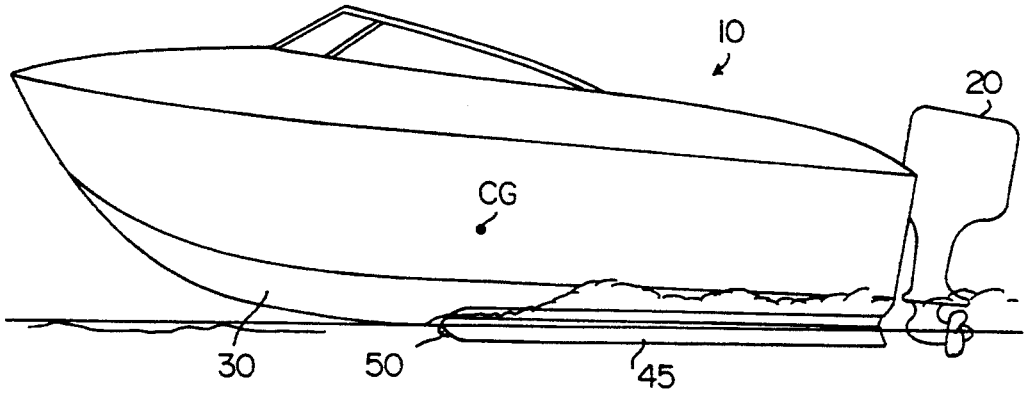
FIG. 9 is a side perspective view of the vessel of FIG. 8 and illustrating the boat operating at planing speed with the wings in a lowered position so as to obtain enhanced operating characteristics.

FIG. 8 illustrates a power boat 10 operating substantially in Position A with longitudinally extending wings 45, 50 flush against primary hull section 30 as the boat proceeds through the water. In contrast, FIG. 9 illustrates a vessel in accordance with the foregoing embodiment which is operating at planing speed with longitudinally extending wings 45, 50 substantially in Position C. In this position, the boat 10 tends to be lifted out of the water and rides on longitudinally extending wings 45, 50 across the water in a manner similar to an individual on water skis. Such lifting effect provided by the longitudinally extending wings, as well as the increased water funneled to the propeller of engine 20, provides increased speed and enhanced operating characteristics to the improved boat hull as opposed to conventionally known boat hull configurations.

Figure 10:
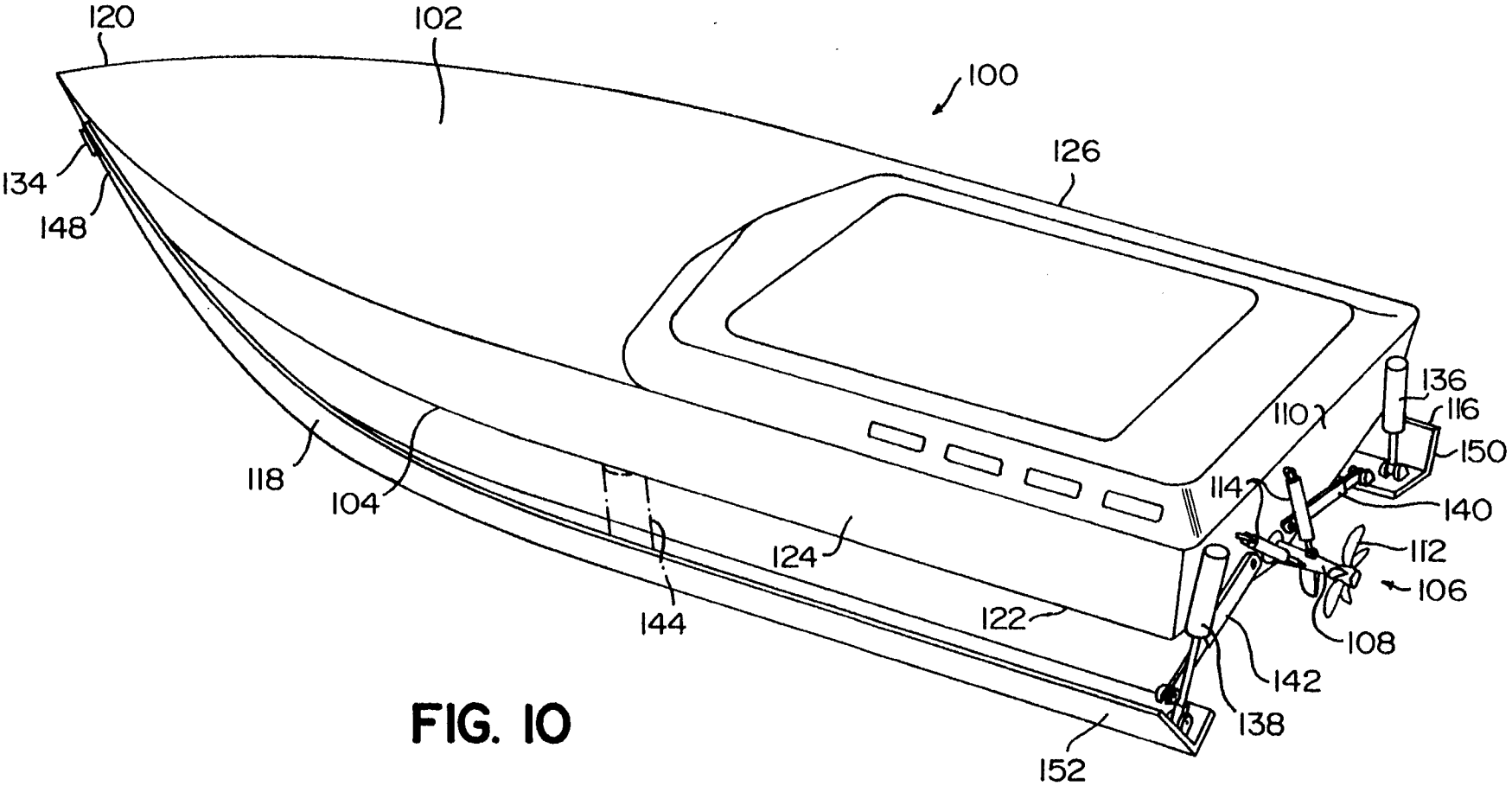
FIG. 10 is a top rear perspective view of a power boat equipped according to an additional embodiment of the present invention.

Referring now to FIG. 10, a power boat 100 is shown equipped according to another presently preferred embodiment of the invention. Boat 100 includes a hull 102 defining a primary hull section 104. Motive force for boat 100 is provided in this case by a surface piercing (Arneson) drive 106, although other drive systems such as inboard or outboard motors may be utilized. Drive 106 includes an extension 108 mounted for articulating movement with respect to transom 110 of hull section 104. A propeller 112 is mounted to the end of extension 108 distal from transom 110. Cylinders 114 selectively move extension 108 to steer boat 100 as well as to provide a degree of trimming.

A pair of elongated ski members 116, 118 extend longitudinally from the fore portion 120 to the aft portion 122 of hull section 104 along the port side 124 and starboard side 126, respectively. Preferably, ski members 116, 118 are laterally spaced by an approximately equal distance from keel 128. As can most easily be seen in FIG. 11, ski members 116, 118 are preferably connected to fore portion 120 in a V-shaped upwardly inclined area 130 generally at or near the keel 128 (hereinafter "forward keel area" 130). Such connection may be facilitated by appropriate coupling joints or a suitable hinge, such as hinges 132, 134.

It should be appreciated that ski members 116, 118 may also comprise a single integrated piece which wraps completely around keel 128 at forward keel area 130. Furthermore, glues or epoxies of sufficient strength may be used in addition to or in lieu of coupling joints to facilitate attachment of ski members 116, 118 to primary hull section 104.

Other than any attachment at fore portion 120, ski members 116, 118 are capable of separation from hull section 104. Thus, appropriate actuator means, such as fluid actuated cylinders 136, 138, may be provided to selectively move respective of ski members 116, 118 between a retracted position contiguous with hull section 104 and an extended position displaced therefrom. Respective telescoping members 140, 142 are also provided to alter the angular orientation of the bottom running surface of ski members 116, 118, as will be explained more fully below. To facilitate connection of cylinders 136, 138 and telescoping members 140, 142, ski members 116, 118 may extend a short distance past respective opposite corners of transom 110.

Preferably, intermediate support means are also associated with each of ski members 116, 118 to provide support at an intermediate location between fore portion 120 and aft portion 122. Such intermediate support means associated with ski member 118 are diagrammatically represented by reference number 144. Similar means are also provided for ski member 116. It is contemplated that such support means 144 may comprise a number of appropriate means of providing such support, such as an air bag or fluid actuated cylinder.

Figure 11:
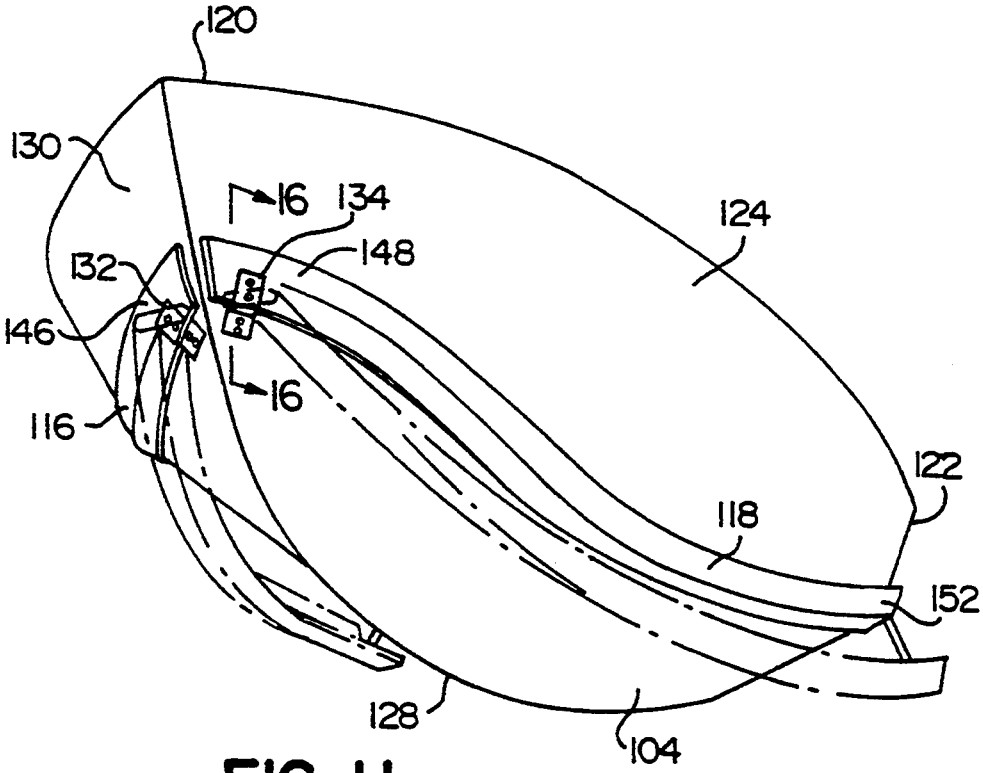
FIG. 11 is a bottom frontal perspective view of the power boat shown in FIG. 10.
Figure 12:
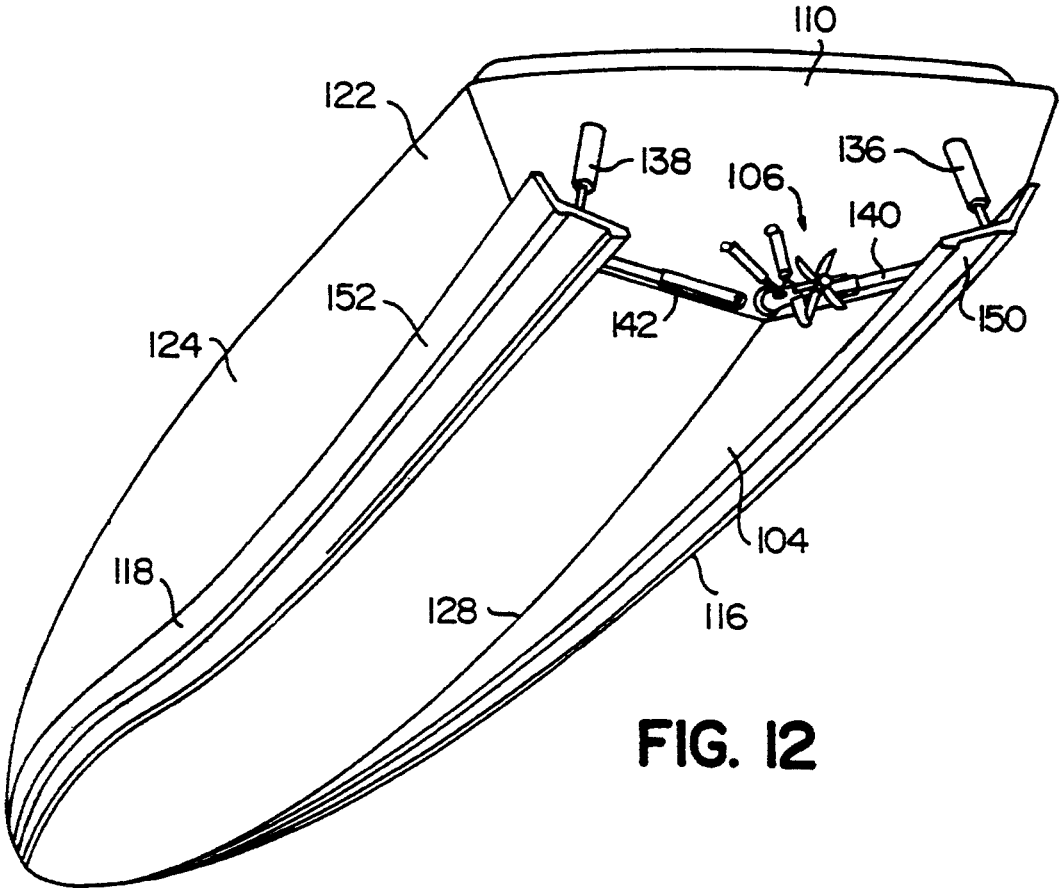
FIG. 12 is bottom rear perspective view of the power boat shown in FIG. 10.

The relative movement of ski members 116, 118 may be best understood with combined reference to FIGS. 10–12. Specifically, FIG. 10 illustrates ski members 116, 118 in the extended position. The transition of ski members 116, 118 from the retracted position to the extended position, or vice versa, is shown in FIG. 11. The retracted position is illustrated in FIG. 12, in which it can be seen that ski members 116, 118 are nested against the outside surface of hull section 104.

To facilitate such nesting, the respective inner surfaces of ski members 116, 118 are generally complementary to corresponding portions of the outer surface of hull section 104. In the illustrated embodiment in which each of ski members 116, 118 are constructed having a relatively thin configuration, respective flat portions 146, 148 are provided at the point of attachment near forward keel area 130. The flat portions 146, 148 are integrally transformed into respective angled portions 150, 152, generally matching the contour of hull section 104 along the longitudinal extent of ski members 116, 118.

Figure 13:
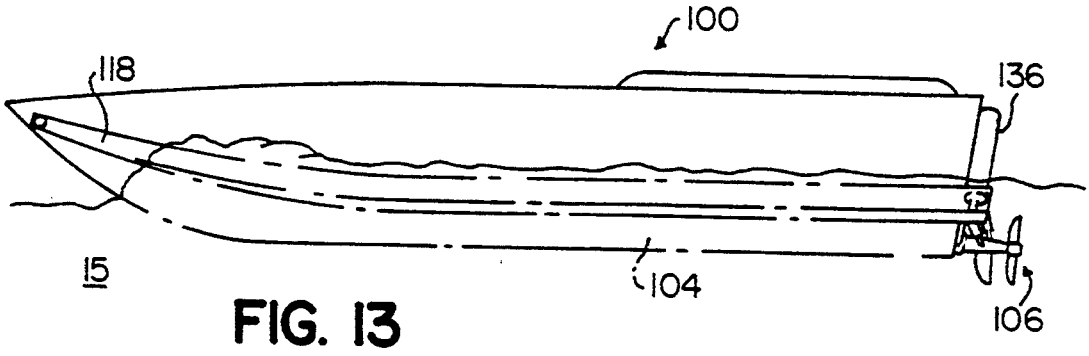
FIGS. 13 and 14 are side elevations of a boat in the water utilizing ski members constructed according to the invention in the retracted first position and extended second position, respectively.
Figure 14:
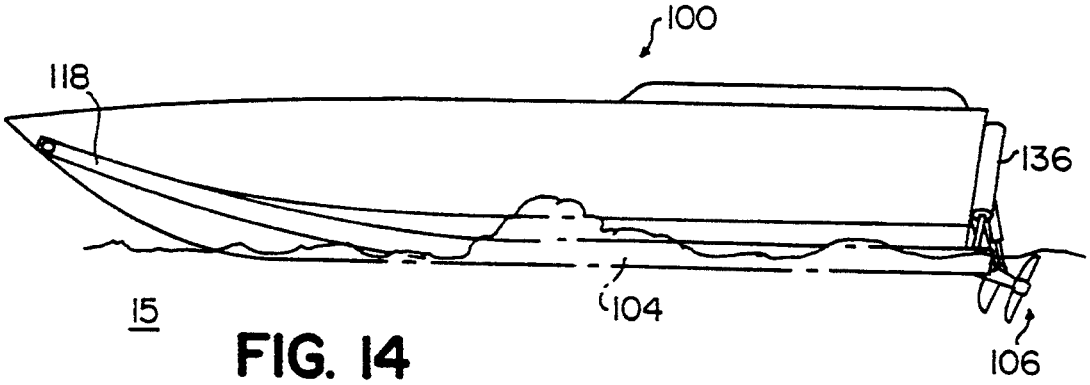

FIGS. 13 and 14 illustrate the operation of boat 100 in water 15 with-ski members 116, 118 in the retracted position and extended position, respectively. As can be seen, hull section 104 is lifted out of the water to a significant degree when ski members 116, 118 are extended. As a result, much of the frictional contact between hull section 104 and water 15 may been eliminated. Additionally, the displacement, or "groove" created in water 15 by hull section 104 is much smaller when ski members 116, 118 are extended. Because such groove has a tendency to push water out from either side of boat 100, horsepower is needed to draw such water into propeller 107. Thus, when ski members 116, 118 are extended, water may be drawn to propeller 107 more easily, thus significantly increasing speed and fuel efficiency.

Figure 15:
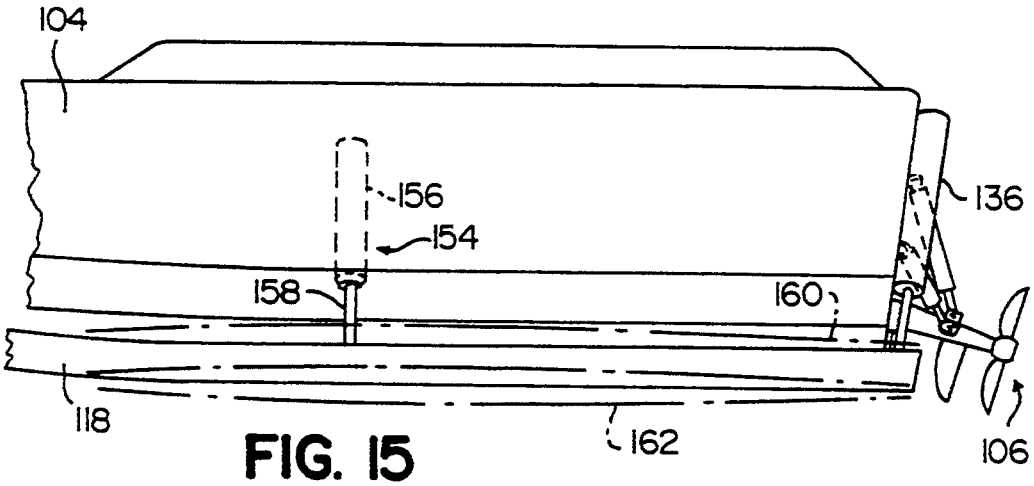
FIG. 15 is a partial side elevation illustrating inward and outward arcuate contouring of a ski member constructed according to the invention to selectively alter the attitude of the boat during operation.

As shown in FIG. 15, intermediate support is provided in this case to ski member 118 by a fluid actuated cylinder 154. A similar cylinder would provide intermediate support to ski member 116. The housing 156 of cylinder 154 is preferably mounted within hull section 104. A reciprocative cylinder rod 158 extends through a hole defined in hull section 104 and is connected to an inside surface of ski member 118. Preferably, appropriate fluid seals would be provided egress location of rod 158 to prevent water from encroaching the inner region of hull section 104.

Generally, the operation of cylinder 154 is coordinated with cylinder 136. However, cylinder 154 may also be selectively controlled when ski member 118 is in the extended position to cause a slight retraction or protraction of rod 158. As a result, ski member 118 will be flexed into respective inward or outward arcuate contours along its longitudinal length (as shown in phantom and designated by reference numbers 160 and 162). Such arcuate contours may be utilized to selectively alter the disposition of boat 100 during operation in a similar manner to trim tabs such as have been utilized in the prior art. Therefore, the need for such trim tabs may generally be eliminated.

Figure 16:
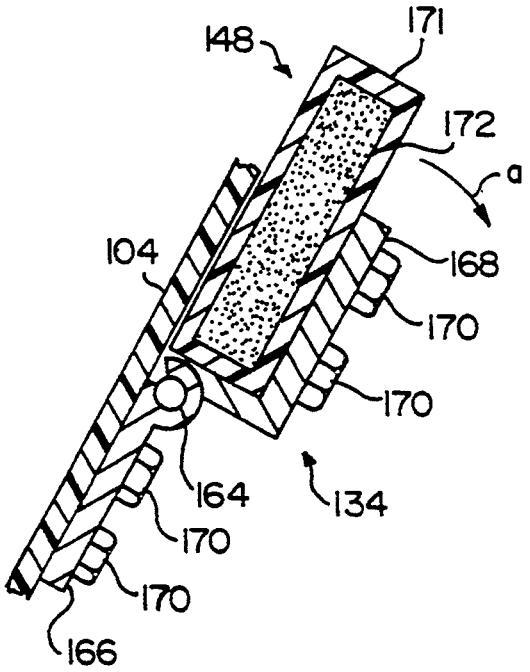
FIG. 16 is a partial cross-section of a hinge as taken along lines 16—16 of FIG. 11.

The operation of hinge 134 may be best understood with reference to FIG. 16. Such a hinge generally includes a hinge pin 164 which extends longitudinally in the direction of ski member 118. Pin 164 is maintained by a mounting plate 166, which is attached to hull section 104. A second mounting plate 168, which is attached to flat portion 148, engages pin 164 for pivotal movement with respect thereto as shown by arrow A. Plates 166 and 168 may be attached via bolts 170 or other appropriate means of attachment. FIG. 16 also illustrates the internal construction of ski member 118. Preferably, ski members of the invention are constructed having a triaxial glass outer portion 171 and a foam core 172.

Figure 17:
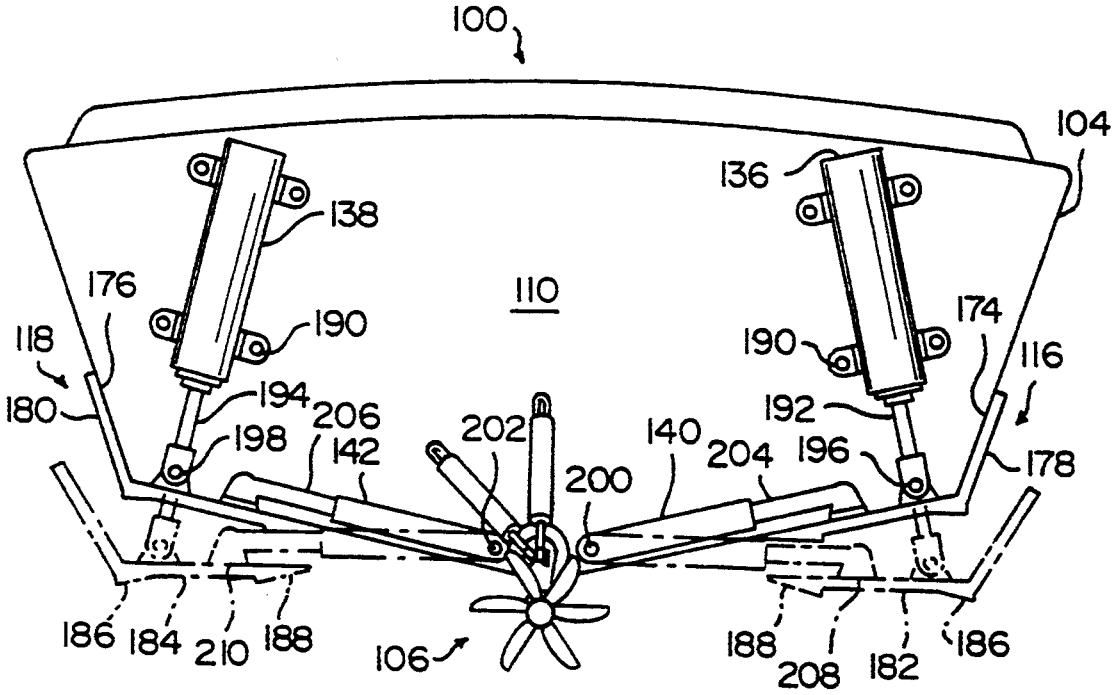
FIG. 17 is an end view of the power boat shown in FIG. 10 to clearly show the actuator means for selectively moving the ski members between retracted and extended positions.

Other details of the movement of ski members 116, 118 can be appreciated with reference to FIG. 17. Ski members 116, 118 define respective inner surfaces 174, 176 which are generally complementary to associated portions of hull section 104, as described above. Due to the angled configuration of ski members 116, 118 along a substantial extent of hull section 104, outer surfaces of ski members 116, 118 will define respective side running surfaces 178, 180 and bottom running surfaces 182, 184. This angled configuration facilitates turning of boat 100 when ski members 116, 118 are extended into the second position by generally preventing an outer edge from catching in the water during such turn.

In presently preferred embodiments, bottom running surfaces 182, 184 each define two longitudinal steps 186, 188 running substantially the length of ski members 116, 118. Thus, when ski members 116, 118 are in the retracted position, steps 186, 188 will form respective chines such as may appear on a typical V-hull design. In many retrofit applications, it may be desirable to eliminate stepped portions 188 and narrow the width of bottom running surfaces 182, 184 by a corresponding amount. This will permit ski members 116, 118 to nest in a recess defined by the preexisting inner chine of the boat hull.

As shown, cylinders 136, 138 may be fixedly attached to transom 110 by-bolts 190 or other appropriate means of such attachment. Respective cylinder rods 192, 194 of cylinders 136, 138 are pivotally connected to inner surfaces 174, 176 at respective pivots 196, 198. Telescoping members 140, 142 are connected to transom 110 at one end by respective pivots 200, 202. Telescoping elements 204, 206 of respective telescoping members 140, 142 are fixedly attached to inner surfaces 174, 176 at attachment locations 208, 210, respectively.

In presently preferred embodiments, the extended position into which ski members 116, 118 may be displaced includes a virtual infinite number of positions within a given range. The fixed attachment of telescoping elements 204, 206 to respective inner surfaces 174, 176 causes an angular disposition of bottom running surfaces 182, 184 to vary as cylinder rods 192, 194 are extended. In other words, bottom running surfaces 182, 184 of each of ski members 116, 118 will rotate about the longitudinal axis thereof as shown. For example, as can be seen FIG. 17, moderate extension of cylinder rods 192, 194 places bottom running surfaces 182, 184 in a plane substantially horizontal and parallel to the surface of the water. This is analogous to the position B of longitudinal extending wings 45, 50. Further extension of cylinder rods 192, 194 will cause bottom running surfaces 182, 184 to attain a slight inverted V, such as position C of longitudinal extending wings 45, 50. As a result of such movement of ski members 116, 118 boat hull 102 may simulate a number of different hull configurations in operation. This allows the user to selectively enhance the operating characteristics of boat 100 depending on the prevailing conditions.

Figure 18:
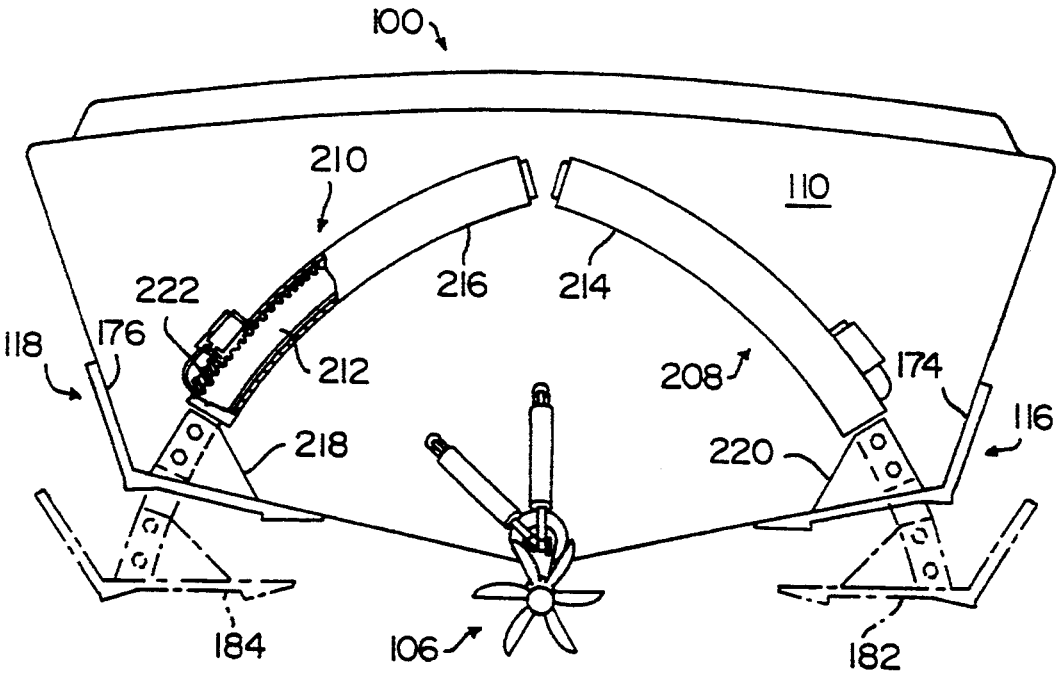
FIGS. 18 and 19 are end views similar to FIG. 17 but illustrating alternative actuator means for selectively moving the ski members.

FIG. 18 illustrates alternative actuator means which can be used to facilitate movement of ski members 116, 118 into the extended position. In this case, respective rack assemblies 208, 210 are mounted to transom 110. Rack assemblies 208, 210 each include an arcuate rack element (such as rack element 212 of rack assembly 210) mounted within a protective housing 214, 216. The respective rack assemblies are fixedly attached to inner surfaces 174, 176 of ski members 116, 118 such as by respective attachment brackets 218, 220. Ski members 116, 118 are extended by operation of a gear element in meshing engagement with teeth on the associated rack element. For example, rack element 212 has teeth along its outer arcuate surface in meshing engagement with a worm gear 222. The arcuate shape of the rack elements causes bottom running surfaces 182, 184 of ski members 116, 118 to vary in angular disposition selectively to selectively enhance the operating characteristics of boat 110 as described above.

Figure 19:
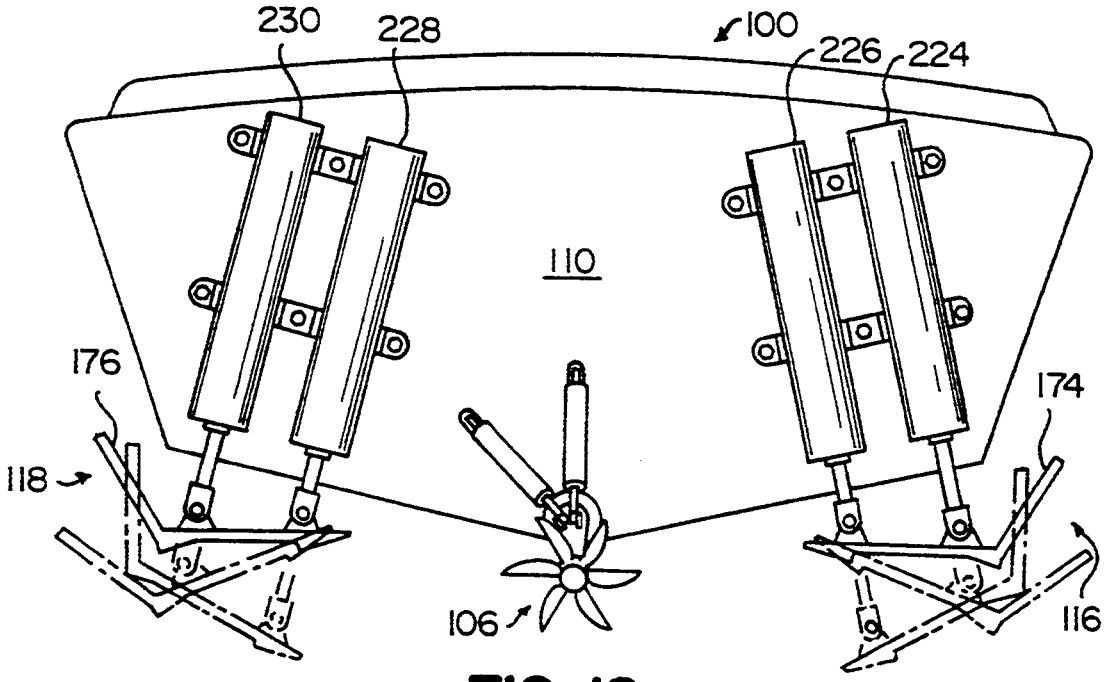

FIG. 19 illustrates still an additional embodiment of actuator means to facilitate movement of ski members 116, 118. In this case, inner surface 174 of ski member 116 is pivotally connected to a pair of fluid actuated cylinders 224, 226 mounted to transom 110. Similarly, inner surface 176 of ski member 118 is pivotally connected to a pair of cylinders 228, 230. This construction may be advantageous in many applications because the angular disposition of bottom running surfaces 182, 184 may be varied over a wide range with ski members 116, 118 fully extended. For example, this embodiment permits boat 100 to operate anywhere between extremes of a simulated deep V to a simulated inverted V (catamaran) during full extension of ski members 116, 118. Intermediate configurations, such as a simulated moderate V or a flat bottom skiff are also possible.

Figure 20:
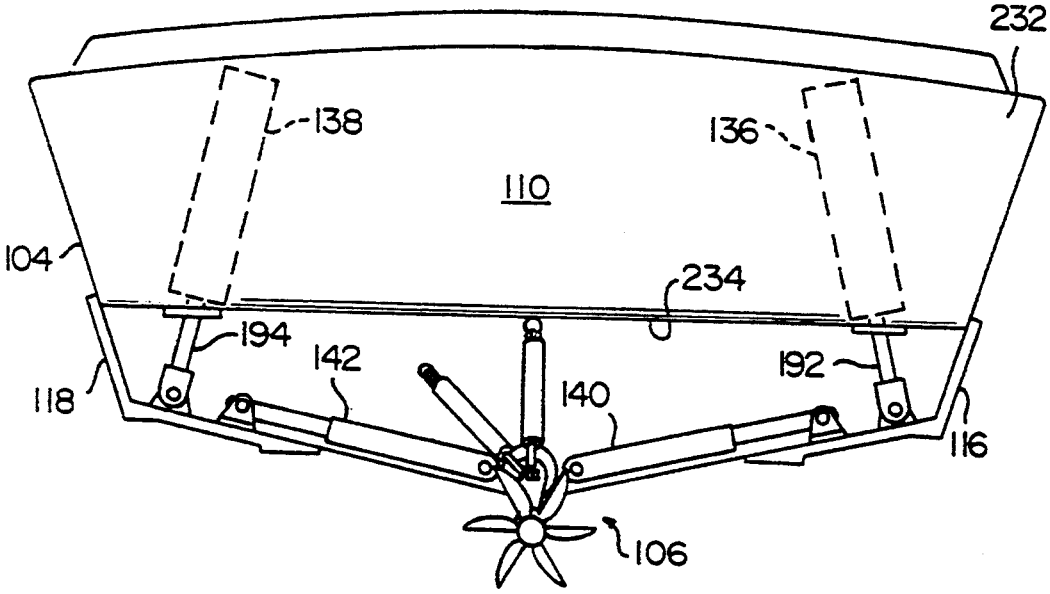
FIG. 20 is an end view similar to FIG. 17 illustrating a boat transom having a stepped portion.

FIG. 20 illustrates an embodiment in which primary hull section 104 includes a transverse stepped portion 232 at transom 110. Stepped portion 232 defines a generally horizontal surface 234, under which drive 106 is mounted. Such a configuration permits the body portion of cylinders 136, 138 to be mounted internal of hull section 104. Rods 192, 194 may then extend through holes defined in surface 234. The overhang caused by surface 234 may permit connection of ski members 116, 118 without requiring that their length extend past stepped portion 232. As a result, a more custom appearance may be achieved.

Figure 21:
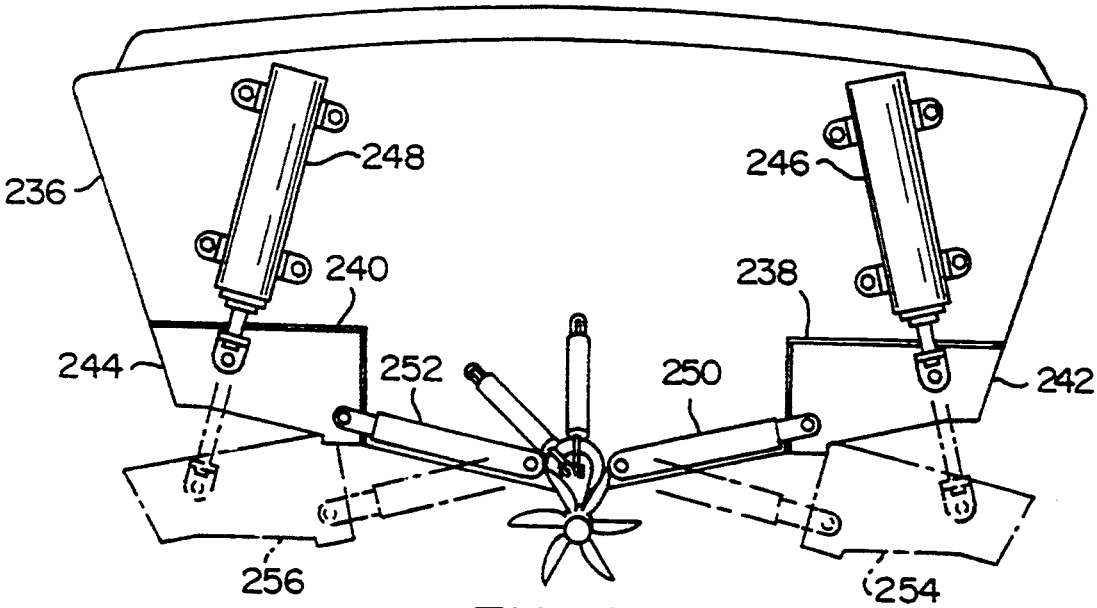
FIG. 21 is an end view illustrating box-like ski members adapted to be received into longitudinal recesses defined in the boat hull.

In many applications, it will be desirable for the primary hull section to define recesses adapted to receive the elongated ski members. In the embodiment illustrated in FIG. 21, for example, hull section 236 defines a pair of longitudinal recesses 238, 240 substantially extending the length thereof. As can be seen, recesses 238, 240 are generally complementary to respective ski members 242, 244. Ski members 242, 244 include a generally quadrilateral portion along the length of hull section 236 such that ski members 242, 244 attain a box-like appearance. This box-like configuration may be advantageous in certain applications due to a relatively high degree of structural rigidity afforded thereby. Here, respective cylinders 246, 248 and telescoping members 250, 250 are provided to displace ski members 242, 244 into the extended position in a similar manner to that described above.

It can thus be seen that the invention provides longitudinally extending wings and ski members for selectively altering the operating characteristics of a boat or other vessel. As discussed, embodiments of the present invention may be constructed as an integral part of the hull with recesses adapted to receive the movable elements as described above. It is also within the scope of the present invention for the longitudinally extending wing or ski member arrangements to be provided as an attachment for adapting a conventional hull to the present invention. The concepts of such embodiment will be the same as discussed above with respect to the various embodiments. It should also be noted that the size and construction material of embodiments of the invention may vary depending on the application, i.e., recreational powerboat or large naval vessel, without departing from the scope of the present invention.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to be limitative of the invention so further described in such appended claims.

What is claimed is:

1. An improved boat hull, said hull comprising:

a primary hull section extending in a longitudinal direction and defining a bottom of a boat, said primary hull section including a fore and aft portion;

first and second longitudinally extending lift wings each pivotally attached to said primary hull section along an axis extending in the longitudinal direction of the primary hull section, said wings having a width narrower than the width of the primary hull section and extending from the aft portion of the primary hull section along the length of the primary hull section to a point past the center of gravity of the boat; and pivoting means for pivoting said longitudinally extending lift wings between at least a first position substantially flush with said primary hull section and a second position angularly past a plane substantially parallel to the surface of the water so as to form at least an inverted V configuration, said pivoting means further maintaining said wings in such positions, whereby said wings can be adjusted between such positions to enhance the performance of the boat in a variety of water conditions and boat speeds.

2. An improved boat hull as in claim 1 above, wherein said longitudinally extending wings are infinitely pivotal between said first and second positions.

3. An improved boat hull as in claim 1 above, wherein said pivoting means for pivoting said longitudinally extending wings includes at least one fluid actuated cylinder attached between said hull and the aft portions of said longitudinally extending wings.

4. An improved boat hull as in claim 1, wherein said wings are each substantially rectangular and include an inside edge portion, an outside edge portion and front and back edge portions, said wings each being longer between said front and back edge portions than a width between said inside and outside edge portions and further being narrower than said primary hull section, and wherein said wings are attached to said primary hull section at their inside edge portions.

5. An improved boat hull as in claim 4, wherein said outside back edge portions of said wings are attached to said means for pivoting said longitudinally extending wings.

6. An improved boat hull as in claim 4, wherein an outer corner portion of said outside front edge portions of said wings are curved upwardly into an upturned foil to provide lift.

7. An improved boat hull as in claim 1, wherein said wings are pivoted about separate parallel axes.

8. An improved boat hull, said hull comprising:

a primary hull section extending in a longitudinal direction and defining a bottom of a boat, said primary hull section including a fore and aft portion;

first and second longitudinally extending wings each pivotally attached to said primary hull section along an axis extending in the longitudinal direction of the primary hull section, said wings extending from the aft portion of the primary hull section along the length of the primary hull section to a point past the center of gravity of the boat;

wherein said wings are substantially rectangular and include an inside edge portion, an outside edge portion and front and back edge portions, said wings being longer between said front and back edge portions than a width between said inside and outside edge portions and further being narrower than said primary hull section, an outer corner portion of said outside edge portions of said wings being curved upwardly into an upturned foil, and wherein said wings are attached to said primary hull section at their inside edge portions; and means for pivoting said longitudinally extending wings between at least a first position and a second position and maintaining said wings in such positions, whereby said wings can be adjusted between such positions to enhance the performance of the boat in a variety of water conditions and boat speeds.

9. An improved boat hull as in claim 8, wherein said wings are pivoted about a common axis along the longitudinal center line of said primary hull section.

10. An improved boat hull as set forth in claim 1, wherein said wings are pivotally attached along substantially their entire length.

11. A lift mechanism for a powered boat including a hull with a longitudinal centerline and a motor for propelling the boat through the water, said lift mechanism comprising:

a plurality of longitudinally extending wings, each said wing being substantially rectangular and including an inside edge and an outside edge, said inside edges being pivotally attached to said hull adjacent the longitudinal centerline of said boat, said wings extending from a position adjacent the aft portion of said hull to a position adjacent a longitudinally middle portion of said hull, an outer corner portion of a front edge portion of said wings being curved upwardly into an upturned foil to provide lift; and power operated means for pivoting said outside edges of said wings to a position where said wings form an inverted V-shaped configuration extending below said hull so that in said V-shaped configuration position, when said boat reaches a predetermined speed, said boat is lifted out of the water and said wings substantially support said boat on the water for movement thereacross.

12. A lift mechanism as in claim 11, wherein said power operated means is infinitely adjustable so that said wings can be pivoted between a position substantially flush with said hull and in an inverted V position.

13. An improved boat hull, said hull comprising:

a primary hull section having a length extending in a longitudinal direction and defining a bottom of a boat, said primary hull section including a fore portion and an aft portion;

first and second elongated ski members each having a longitudinal axis and each extending from said fore portion to said aft portion in spaced apart relationship, said ski members separable from said primary hull section substantially along the length thereof; and actuator means for selectively moving said ski members between a retracted first position generally adjacent to said primary hull section and an extended second position wherein portions of said ski members capable of separation from said primary hull section are separated therefrom, said actuator means being further operative to selectively rotate each of said ski members about the longitudinal axis of the respective ski member, whereby said ski members may be extended into said second position as said improved boat hull is traversing a body of water to permit said boat hull to generally move thereon.

14. An improved boat hull, said hull comprising:

a primary hull section having a length extending in a longitudinal direction and defining a bottom of a boat, said primary hull section including a fore portion and an aft portion;

first and second elongated ski members extending from said fore portion to said aft portion in spaced apart relationship, said ski members separable from said primary hull section substantially along the length thereof;

actuator means for selectively moving said ski members between a retracted first position generally adjacent to said primary hull section and an extended second position wherein portions of said ski members capable of separation from said primary hull section are separated therefrom;

support means positioned at an intermediate location between said fore portion and said aft portion for providing intermediate support to said ski members while said ski members are disposed in said second position, wherein said support means are further operative to flex respective of said ski members into selected inward and outward arcuate contours along the longitudinal extent thereof, whereby said ski members may be extended into said second position as said improved boat hull is traversing a body of water to permit said boat hull to generally move thereon.

15. An improved boat hull as in claim 13, wherein said ski members are attached to said fore portion.

16. An improved boat hull as in claim 15, wherein said first and second elongated ski members are connected to said fore portion substantially at a forward keel area thereof.

17. An improved boat hull as in claim 16, wherein said ski members are connected to said fore portion utilizing a hinge.

18. An improved boat hull as in claim 13, wherein said actuator means comprises first and second fluid actuated cylinders located at said aft portion of said primary hull section, each of said cylinders pivotally attached to a respective one of said ski members.

19. An improved boat hull as in claim 18, wherein said actuator means further includes third and fourth fluid actuated cylinders each pivotally attached to a respective one of said ski members, said third and fourth fluid actuated cylinders operative to cooperate with respective of said first and second fluid actuated cylinders to selectively vary the angular disposition of a bottom running surface thereof.

20. An improved boat hull as in claim 18, wherein said actuator means further comprises first and second telescopic elements pivotally attached to said primary hull section and fixedly attached to respective of said ski members to vary the angular disposition of a bottom running surface thereof as said ski member is moved between said first position and said second position.

21. An improved boat hull as in claim 18, wherein a transom of said primary hull section includes a stepped portion defining a generally horizontal surface, said at least two fluid actuated cylinders mounted on an inside of said stepped portion such that piston rods respectively associated therewith extend through said horizontal surface.

22. An improved boat hull as in claim 13, wherein said actuator means comprises first and second rack assemblies located at said aft portion of said primary hull section, each said rack assembly including a gear element in meshing engagement with an arcuate rack fixedly attached to a respective of said ski members so as to vary the angular disposition of a bottom running surface thereof as said ski member is moved between said first position and said second position.

23. An improved boat hull, said hull comprising:

a primary hull section having a length extending in a longitudinal direction and defining a bottom of a boat, said primary hull section including a fore portion and an aft portion, said fore portion having a V-shaped upwardly inclined forward keel area;

first and second elongated ski members extending from said fore portion to said aft portion in spaced apart relationship, said ski members separable from said primary hull section substantially length thereof, said first and second elongated ski members being connected to and substantially wrapping around said V-shaped upwardly inclined forward keel area of said fore portion so as to extend from said forward keel area to said aft portion and to opposite bottom corners of a transom thereof; and actuator means for selectively moving said ski members between a retracted first position generally adjacent to said primary hull section and an extended second position wherein portions of said ski members capable of separation from said primary hull section are separated therefrom, whereby said ski members may be extended into said second position as said improved boat hull is traversing a body of water to permit said boat hull to generally move thereon.

24. An improved boat hull as in claim 23, wherein said first and second elongated ski members each comprise a generally thin ski member.

25. An improved boat hull as in claim 24, wherein each said ski member is configured having a generally flat first portion integrally extending in a longitudinal direction into an angled second portion, an inner surface of said ski member generally complementary to a corresponding portion of an outer surface of said primary hull section.

26. An improved boat hull as in claim 25, wherein said actuator means further includes support means for providing intermediate support to respective of said ski members whiles disposed in said second position, said support means being further operative to flex respective of said ski members into selected inward and outward arcuate contours along a longitudinal extent thereof.

27. An improved boat hull as in claim 25, wherein a bottom running surface of said angled second portion has two longitudinal steps forming respective chines.

28. An improved boat hull as in claim 23, wherein said primary hull section defines first and second longitudinal recesses into which said ski members are received when in said first position.

29. An improved boat hull as in claim 28, wherein said first and second elongated ski members each comprise a ski member adapted to be received into a respective longitudinal recess such that an outer surface thereof will be flush with said primary hull section when in said first position.

30. An improved boat hull as in claim 29, wherein each said ski member includes a generally quadrilateral portion to form a box-like ski member.

31. An improved boat hull as in claim 30, wherein a bottom running surface of said quadrilateral portion has two longitudinal steps forming respective chines.

32. An improved boat hull as in claim 30, wherein said actuator means further includes support means positioned at an intermediate location between said fore portion and said aft portion for providing intermediate support to respective of said ski member while disposed in said second position.

33. An apparatus for attachment to a boat hull of the type extending in a longitudinal direction from a fore portion to an aft portion and extending in a transverse direction from a port side to a starboard side, said apparatus comprising:

first and second elongated ski members each having a longitudinal axis and each having a length extending from the aft portion to a location past a center of gravity of the hull, said ski members extending along the port side and the starboard side, respectively;

said ski members each having a relatively thin shape and defining an inner surface generally complementary to an associated outer surface of the boat hull, said ski members being separable from the boat hull at least along a substantial portion of their respective lengths; and actuator means for selectively moving said ski members between a retracted first position generally adjacent to the boat hull and an extended second position wherein portions of said ski members capable of separation from said boat hull are separated therefrom, said actuator means being further operative to selectively rotate each of said ski members about the longitudinal axis of the respective ski member, whereby said ski members may be extended into said second position as the boat hull is traversing a body of water to permit said boat hull to generally move thereon.

34. An apparatus as in claim 33, wherein said ski members have a length substantially equivalent to the length of the boat hull and are adapted to be connected to a forward keel area of the fore portion, said ski members extending substantially in parallel to the aft portion of the boat hull to respective bottom corners of a transom thereof.

35. An apparatus as in claim 34, wherein said actuator means comprises first and second fluid actuated cylinders mountable at said transom, each of said cylinders pivotally attached to a respective one of said ski members.

36. An apparatus as in claim 35, wherein said actuator means further includes third and fourth fluid actuated cylinders each pivotally attached to a respective one of said ski members, said third and fourth fluid actuated cylinders operative to cooperate with respective of said first and second fluid actuated cylinders to selectively vary the angular disposition of a bottom running surface of said respective one of said ski members.

37. An apparatus as in claim 35, wherein said actuator means further comprises first and second telescopic elements for pivotal attachment to the transom, said first and second telescopic elements fixedly attached to a respective one of said ski members to vary the angular disposition of a bottom running surface thereof as said respective one of said ski members is moved between said first position and said second position.

38. An apparatus as in claim 34, wherein said actuator means comprise first and second rack assemblies mountable at the aft portion of the boat hull, each said rack assembly including a gear element in meshing engagement with an arcuate rack fixedly attached to a respective one of said ski members so as to vary the angular disposition of a bottom running surface thereof as said ski member is moved between said first position and said second position.

39. An apparatus as in claim 34, wherein each said ski member is configured having a generally flat first portion integrally extending in a longitudinal direction into an angled second portion.

40. An apparatus as in claim 33, wherein said actuator means further includes support means for positioning at an intermediate location between the fore portion and the aft portion to provide intermediate support to respective of said ski members while disposed in said second position, said support means being further operative to flex respective of said ski members into selected inward and outward arcuate contours along a longitudinal extent thereof.

* * * * *